US010677478B2

(12) United States Patent
Park et al.

(10) Patent No.: US 10,677,478 B2
(45) Date of Patent: Jun. 9, 2020

(54) HEAT RADIATION UNIT AND OUTDOOR UNIT OF AIR CONDITIONER HAVING THE SAME

(71) Applicant: LG ELECTRONICS INC., Seoul (KR)

(72) Inventors: Heewoong Park, Seoul (KR); Jeongseob Shin, Seoul (KR); Seungtaek Oh, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 63 days.

(21) Appl. No.: 15/016,910

(22) Filed: Feb. 5, 2016

(65) Prior Publication Data

US 2016/0231008 A1 Aug. 11, 2016

(30) Foreign Application Priority Data

Feb. 9, 2015 (KR) ..... 10-2015-0019741

(51) Int. Cl.
*F24F 1/24* (2011.01)
*F24F 1/16* (2011.01)

(52) U.S. Cl.
CPC . *F24F 1/24* (2013.01); *F24F 1/16* (2013.01)

(58) Field of Classification Search
CPC ..... F24F 1/24; F24F 1/16; F24F 1/14; F24F 1/18; F24F 1/20; F24F 1/22; F24F 1/26
USPC ..... 165/80.1, 104.33
See application file for complete search history.

(56) References Cited

U.S. PATENT DOCUMENTS 6,102,110 A * 8/2000 Julien ..... F28D 15/0275 165/104.33
6,243,268 B1 * 6/2001 Kang ..... H01L 23/473 165/104.21
6,883,594 B2 * 4/2005 Sarraf ..... F28D 15/0266 165/104.33
7,093,648 B1 * 8/2006 Cheng ..... H01L 23/427 165/104.33
7,138,706 B2 * 11/2006 Arai ..... H01L 21/565 257/675

(Continued)

FOREIGN PATENT DOCUMENTS

CN 103486752 A 1/2014
CN 103604168 A 2/2014

(Continued)

*Primary Examiner* — Tho V Duong
*Assistant Examiner* — Raheena R Malik
(74) *Attorney, Agent, or Firm* — Dentons US LLP

(57) ABSTRACT

A heat radiation unit is disclosed. The heat radiation unit includes a heat radiation member thermally connected to a heat source, to radiate heat generated from the heat source, a refrigerant pipe thermally connected to the heat radiation member while being formed therein with a channel, through which refrigerant flows, a pipe jacket coupled to the heat radiation member, and formed with a receiving groove to receive a portion of the refrigerant pipe, and a cover bracket to press the portion of the refrigerant pipe received in the receiving groove of the pipe jacket in a downward direction of the receiving groove. An outdoor unit of an air conditioner is also disclosed. The outdoor unit includes a case to form an appearance of the outdoor unit, a heat source disposed in the case, and the heat radiation unit connected to the heat source, to radiate heat from the heat source.

6 Claims, 9 Drawing Sheets

(56) References Cited

U.S. PATENT DOCUMENTS

| | | | | |
|---|---|---|---|---|
| 7,165,603 | B2 * | 1/2007 | Mochizuki | F28D 15/02 165/104.21 |
| 7,426,112 | B2 * | 9/2008 | Chi-Wei | H01L 23/4093 165/104.26 |
| 7,440,279 | B2 * | 10/2008 | Lai | H01L 23/427 165/104.21 |
| 7,562,696 | B2 * | 7/2009 | Lin | F28D 15/0266 165/104.21 |
| 7,661,466 | B2 * | 2/2010 | Li | F28D 15/0266 165/104.33 |
| 7,757,751 | B2 * | 7/2010 | Zhou | F28D 15/0275 165/104.33 |
| 8,464,548 | B2 * | 6/2013 | Okuda | F24F 1/22 62/259.2 |
| 9,523,529 | B2 * | 12/2016 | Oguri | F24F 1/22 |
| 2002/0109211 | A1 * | 8/2002 | Shinohara | H01L 23/4334 257/666 |
| 2008/0314556 | A1 * | 12/2008 | Zhou | F28D 15/0266 165/80.3 |
| 2011/0079033 | A1 * | 4/2011 | Okuda | F24F 1/22 62/259.2 |
| 2013/0186599 | A1 * | 7/2013 | Chen | H01L 23/427 165/104.21 |
| 2013/0228312 | A1 * | 9/2013 | Wu | B21D 53/02 165/104.26 |
| 2015/0082822 | A1 * | 3/2015 | Teraki | F24F 1/24 62/259.2 |
| 2015/0082823 | A1 * | 3/2015 | Teraki | H01L 23/473 62/259.2 |
| 2015/0114021 | A1 * | 4/2015 | Oguri | H01L 23/473 62/259.2 |
| 2015/0128631 | A1 * | 5/2015 | Oguri | F24F 1/22 62/259.2 |
| 2015/0271953 | A1 * | 9/2015 | Fujiwara | H05K 7/20254 165/80.4 |

FOREIGN PATENT DOCUMENTS

| | | | |
|---|---|---|---|
| CN | 103688605 | A | 3/2014 |
| CN | 203718987 | U | 7/2014 |
| JP | 2005-45003 | A | 2/2005 |
| JP | 2008-294096 | A | 12/2008 |
| JP | 2011-99577 | A | 5/2011 |
| JP | 2011-99877 | A | 5/2011 |
| JP | 2013-164248 | A | 8/2013 |
| KR | 20-1998-0016410 | U | 6/1998 |
| WO | 2010/087481 | A1 | 8/2010 |
| WO | 2013/157219 | A1 | 10/2013 |
| WO | 2013/161323 | A1 | 10/2013 |

* cited by examiner

HEAT RADIATION UNIT AND OUTDOOR UNIT OF AIR CONDITIONER HAVING THE SAME

CROSS-REFERENCE TO RELATED APPLICATION

This application claims the priority benefit of Korean Patent Application No. 10-2015-0019741, filed on Feb. 9, 2015, in the Korean Intellectual Property Office, the disclosure of which is incorporated herein by reference.

BACKGROUND OF THE INVENTION

1. Field of the Invention

The present invention relates to a heat radiation unit capable of achieving an enhancement in heat radiation efficiency of a heat source.

2. Description of the Related Art

Generally, an air conditioner is an apparatus for cooling or heating an indoor space, using a refrigeration cycle including a compressor, an outdoor heat exchanger, an expansion valve, and an indoor heat exchanger. That is, such an air conditioner may include a cooler for cooling an indoor space, and a heater for heating an indoor space. Alternatively, such an air conditioner may be a cooling and heating air conditioner having a function of cooling or heating an indoor space.

Air conditioners are mainly classified into a window type air conditioner and a separate or split type air conditioner. Both the window type air conditioner and the separate type air conditioner have the same function. However, the window type air conditioner has an integrated structure having both the cooling and heating functions, and is directly installed at a hole formed through a wall in a building or a window provided at a building. On the other hand, the separate type air conditioner is equipped with an indoor unit installed at an indoor space while including an indoor heat exchanger, and an outdoor unit installed at an outdoor space while including an outdoor heat exchanger. The indoor and outdoor units, which are separate from each other, are connected by a refrigerant line.

Operation of various elements of such air conditioners is controlled by a controller. In such a controller, a printed circuit board (PCB) thereof, which is adapted to control various elements of an air conditioner, generates a large amount of heat. To this end, a heat radiation structure is used to radiate heat generated from the PCB. However, such a heat radiation structure may be damaged when the controller is separated or due to other reasons.

Furthermore, although the controller contacts the refrigerant line, for heat radiation, contact between the controller and the refrigerant line may be poor because the refrigerant line has a circular cross-section and, as such, thermal conductivity may become inferior.

SUMMARY OF THE INVENTION

Therefore, the present invention has been made in view of the above problems, and it is an object of the present invention to provide a heat radiation unit including a fixed heat radiation member to effectively radiate heat generated from a controller while contacting the controller, and an outdoor unit of an air conditioner including the heat radiation unit.

Other objects of the invention are not limited to the above-described object, and will become apparent to those having ordinary skill in the art by reference to the following description.

In accordance with an aspect of the present invention, the above and other objects can be accomplished by the provision of a heat radiation unit including a heat radiation member thermally connected to a heat source, to radiate heat generated from the heat source, a refrigerant pipe thermally connected to the heat radiation member while being formed therein with a channel, through which refrigerant flows, a pipe jacket coupled to the heat radiation member, and formed with a receiving groove to receive a portion of the refrigerant pipe, and a cover bracket to press the portion of the refrigerant pipe received in the receiving groove of the pipe jacket in a downward direction of the receiving groove.

In accordance with another aspect of the present invention, there is provided an outdoor unit of an air conditioner including a case to form an appearance of the outdoor unit, a heat source disposed in the case, and a heat radiation unit connected to the heat source, to radiate heat generated from the heat source, wherein the heat radiation unit includes a heat radiation member thermally connected to the heat source, to radiate heat generated from the heat source, a refrigerant pipe thermally connected to the heat radiation member while being formed therein with a channel, through which refrigerant flows, a pipe jacket coupled to the heat radiation member, and formed with a receiving groove to receive a portion of the refrigerant pipe, and a cover bracket to press the portion of the refrigerant pipe received in the receiving groove of the pipe jacket in a downward direction of the receiving groove.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Reference will now be made in detail to embodiments, examples of which are illustrated in the accompanying drawings. However, the present disclosure may be embodied in many different forms and should not be construed as limited to the embodiments set forth herein. Rather, these embodiments are provided so that this disclosure will be thorough and complete, and will fully convey the scope of the disclosure to those skilled in the art. The present disclosure is defined only by the categories of the claims. Wherever possible, the same reference numbers will be used throughout the drawings to refer to the same or like parts.

Hereinafter, the present invention will be described with reference to the drawings for explaining outdoor units of air conditioners according to embodiments of the present invention.

Figure 1:
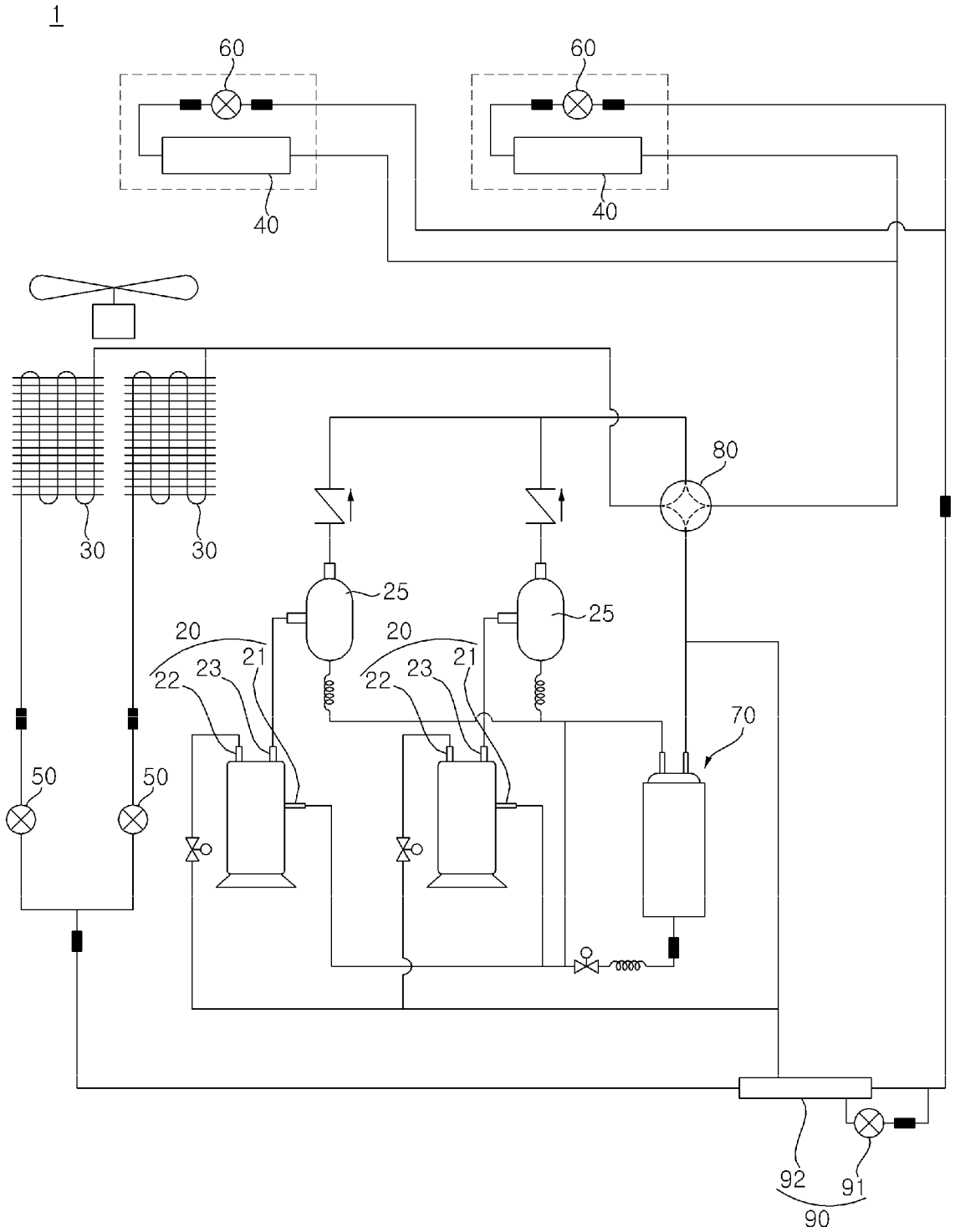
FIG. 1 is a diagram briefly illustrating a configuration of an air conditioner according to an embodiment of the present invention.

FIG. 1 is a diagram briefly illustrating a configuration of an air conditioner according to an embodiment of the present invention.

Referring to FIG. 1, the air conditioner according to the illustrated embodiment, which is designated by reference numeral "1", includes a compressor 20 for compressing refrigerant, an outdoor heat exchanger 30 installed in an outdoor space, to perform heat exchange of refrigerant with outdoor air, and an indoor heat exchanger 40 installed in an indoor space, to perform heat exchange of refrigerant with indoor air. The air conditioner 1 also includes a switching valve 80 for guiding refrigerant discharged from the compressor 20 to the outdoor heat exchanger 30 in a cooling mode while guiding the refrigerant to the indoor heat exchanger 40 in a heating mode.

The air conditioner 1 includes an outdoor unit installed at the outdoor space, and an indoor unit installed at the indoor space. The indoor unit and outdoor unit are interconnected. The outdoor unit includes the compressor 20, the outdoor exchanger 30, an outdoor expansion valve 50, and a gas-liquid separator 70. The indoor unit includes the indoor heat exchanger 40, and an indoor expansion valve 60.

The compressor 20, which is equipped in the outdoor unit, compresses low-temperature and low-pressure refrigerant introduced thereinto into high-temperature and high-pressure refrigerant. Various structures may be applied to the compressor 20. The compressor 20 may be a reciprocating compressor using a cylinder and a piston, a scroll compressor using an orbiting scroll and a fixed scroll, or an inverter compressor configured to adjust a compression degree of refrigerant, based on actual indoor temperature, actual outdoor temperature and the number of indoor units to be driven. A single compressor or a plurality of compressors may be provided. Similarly, a single indoor heat exchanger or a plurality of indoor heat exchangers may be provided, and a single outdoor heat exchanger or a plurality of outdoor heat exchangers may be provided. In the illustrated embodiment, two compressors 20, two indoor heat exchangers 40, and two outdoor heat exchangers 30 are provided. For simplicity of description, the following description will be given in conjunction with one compressor, one indoor heat exchanger, and one outdoor heat exchanger.

The compressor 20 is connected to the switching valve 80 and gas-liquid separator 70. The compressor 20 includes an inlet port 21, into which refrigerant evaporated in the indoor heat exchanger 40 in a cooling mode is introduced or refrigerant evaporated in the outdoor heat exchanger 30 in a heating mode is introduced, and an outlet port 23, from which compressed refrigerant is discharged.

The compressor 20 compresses, in a compression chamber, refrigerant introduced through the inlet port 21. The compressor 20 discharges the compressed refrigerant through the outlet port 23. The refrigerant discharged from the outlet port 23 is fed to the switching valve 80.

The switching valve 80 is a path switching valve for switching between cooling and heating. The switching valve 80 guides refrigerant compressed in the compressor 20 to the outdoor heat exchanger 30 in the cooling mode while guiding the refrigerant to the indoor heat exchanger 40 in the heating mode. That is, the switching valve 80 functions to guide refrigerant compressed in the compressor 20 to a condenser.

The switching valve 80 is connected to the outlet port 23 of the compressor 20 and gas-liquid separator 70 while being connected to the indoor heat exchanger 40 and outdoor heat exchanger 30. In the cooling mode, the switching valve 80 connects the outlet port 23 of the compressor 20 to the outdoor heat exchanger 30 while connecting the gas-liquid separator 70 to the indoor heat exchanger 40. Alternatively, the switching valve 80 may be connected to the indoor heat exchanger 40 and the inlet port 21 of the compressor 20 in the cooling mode.

In the heating mode, the switching valve 80 connects the outlet port 23 of the compressor to the indoor heat exchanger while connecting the gas-liquid separator 70 to the outdoor heat exchanger 30. Alternatively, the switching valve 80 may connect the inlet port 21 of the compressor 20 to the outdoor heat exchanger 30 in the heating mode.

The switching valve 80 may be implemented using various modules capable of connecting different paths. In the illustrated embodiment, the switching valve 80 is constituted by a 4-way valve. Of course, the switching valve 80 may be implemented using a combination of two 3-way valves, various other valves, or a combination thereof.

The outdoor heat exchanger 30 is arranged in the outdoor unit, which is installed in an outdoor space. The outdoor heat exchanger 30 performs heat exchange of refrigerant passing therethrough with outdoor air. The outdoor heat exchanger 30 functions as a condenser to condense refrigerant in the cooling mode while functioning as an evaporator to evaporate refrigerant in the heating mode.

The outdoor heat exchanger 30 is connected to the switching valve 80 and outdoor expansion valve 50. In the cooling mode, refrigerant passing through the outlet port 23 of the compressor 20 and the switching valve 80 after being compressed in the compressor 20 is introduced into the outdoor heat exchanger 30, and is fed to the outdoor expansion valve 50 after being condensed. In the heating mode, refrigerant expanded in the outdoor expansion valve 50 is introduced into the outdoor heat exchanger 30, and is fed to the switching valve 80 after being evaporated.

In the cooling mode, the outdoor expansion valve 50 is completely opened to allow refrigerant to pass therethrough. On the other hand, in the heating mode, opening degree of the outdoor expansion valve 50 is adjusted, and refrigerant is expanded through adjustment of opening degree. The outdoor expansion valve 50 is arranged between the outdoor heat exchanger 30 and an injection module 90.

In the cooling mode, the outdoor expansion valve 50 receives refrigerant discharged from the outdoor heat exchanger 30, and guides the received refrigerant to the injection module 90. In the heating mode, the outdoor expansion valve 50 may expand refrigerant subjected to heat exchange in the injection module 90, and guide the expanded refrigerant to the outdoor heat exchanger 30.

The indoor heat exchanger 40 is arranged in the indoor unit, which is arranged in an indoor space. The indoor heat exchanger 40 performs heat exchange of refrigerant passing therethrough with indoor air. The indoor heat exchanger 40 functions as an evaporator to evaporate refrigerant in the cooling mode while functioning as a condenser to condense refrigerant in the heating mode.

The indoor heat exchanger 40 is connected to the switching valve 80 and indoor expansion valve 60. In the cooling mode, refrigerant expanded in the indoor expansion valve 60 is introduced into the indoor heat exchanger 40, and is fed to the switching valve 80 after being evaporated. In the heating mode, refrigerant passing through the outlet port 23 of the compressor 20 and the switching valve 80 after being compressed in the compressor 20 is introduced into the indoor heat exchanger 40, and is fed to the indoor expansion valve 60 after being condensed.

In the cooling mode, opening degree of the indoor expansion valve 60 is adjusted, and refrigerant is expanded through adjustment of opening degree. On the other hand, in the heating mode, the indoor expansion valve 60 is completely opened to allow refrigerant to pass therethrough. The indoor expansion valve 60 is arranged between the indoor heat exchanger 40 and the injection module 90.

In the cooling mode, the indoor expansion valve 60 expands refrigerant flowing to the indoor heat exchanger 40. In the cooling mode, the indoor expansion valve 60 receives refrigerant discharged from the indoor heat exchanger 40, and guides the received refrigerant to the injection module 90.

The injection module 90 is arranged between the outdoor heat exchanger 30 and the indoor heat exchanger 40. The injection module 90 injects, into the compressor 20, a portion of refrigerant flowing between the outdoor heat exchanger 30 and the indoor heat exchanger 40. That is, the injection module 90 may inject, into the compressor 20, a portion of refrigerant flowing from the compressor 30 or 40 to the corresponding expansion valve. The injection module 90 is connected to the outdoor expansion valve 50 and indoor expansion valve 60.

The injection module 90 includes an injection expansion valve 91 for expanding a portion of refrigerant flowing between the outdoor heat exchanger 30 and the indoor heat exchanger 40, and an injection heat exchanger 92 for performing heat exchange of the refrigerant expanded in the injection expansion valve 91 with the remaining portion of the refrigerant flowing between the outdoor heat exchanger 30 and the indoor heat exchanger 40. The injection heat exchanger 92 guides refrigerant evaporated through heat exchange therein to an injection port 22 of the compressor 20. Of course, the injection module 90 may not be included in the air conditioner 1.

The gas-liquid separator 70 is arranged between the switching valve 80 and the inlet port 21 of the compressor 20. The gas-liquid separator 70 is connected to the switching valve 80 and the inlet port 21 of the compressor 20. The gas-liquid separator 70 separates gas-phase refrigerant and liquid-phase refrigerant from refrigerant evaporated in the indoor heat exchanger 40 in the cooling mode or refrigerant evaporated in the outdoor heat exchanger 30 in the heating mode, and guides the separated gas-phase refrigerant to the inlet port 21 of the compressor 20. That is, the gas-liquid separator 70 separates gas-phase refrigerant and liquid-phase refrigerant from refrigerant evaporated in the evaporator 30 or 40, and guides the separated gas-phase refrigerant to the inlet port 21 of the compressor 20.

The gas-liquid separator 70 receives refrigerant evaporated from the outdoor heat exchanger 30 or indoor heat exchanger 40 via the expansion valve 80. Accordingly, the gas-liquid separator 70 is maintained at a temperature of about 0 to 5° C. and, as such, surrounding heat may be absorbed by the gas-liquid separator 70. The surface temperature of the gas-liquid separator 70 is lower than the temperature of refrigerant condensed in the outdoor heat exchanger 30 in the cooling mode. The gas-liquid separator 70 may have a cylindrical shape elongated in a longitudinal direction.

Figure 2:
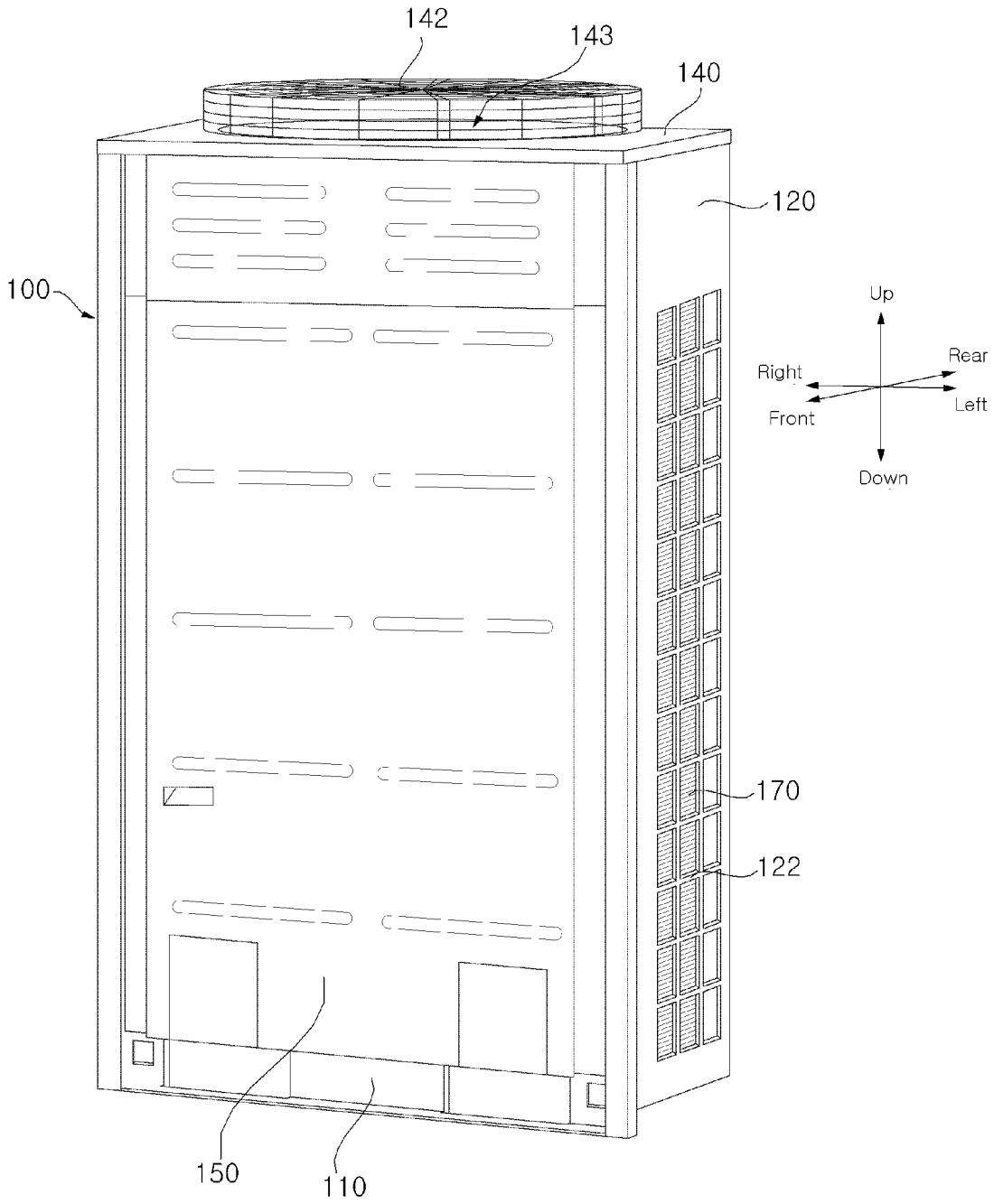
FIG. 2 is a perspective view illustrating a configuration of an outdoor unit of the air conditioner according to an embodiment of the present invention.
Figure 3:
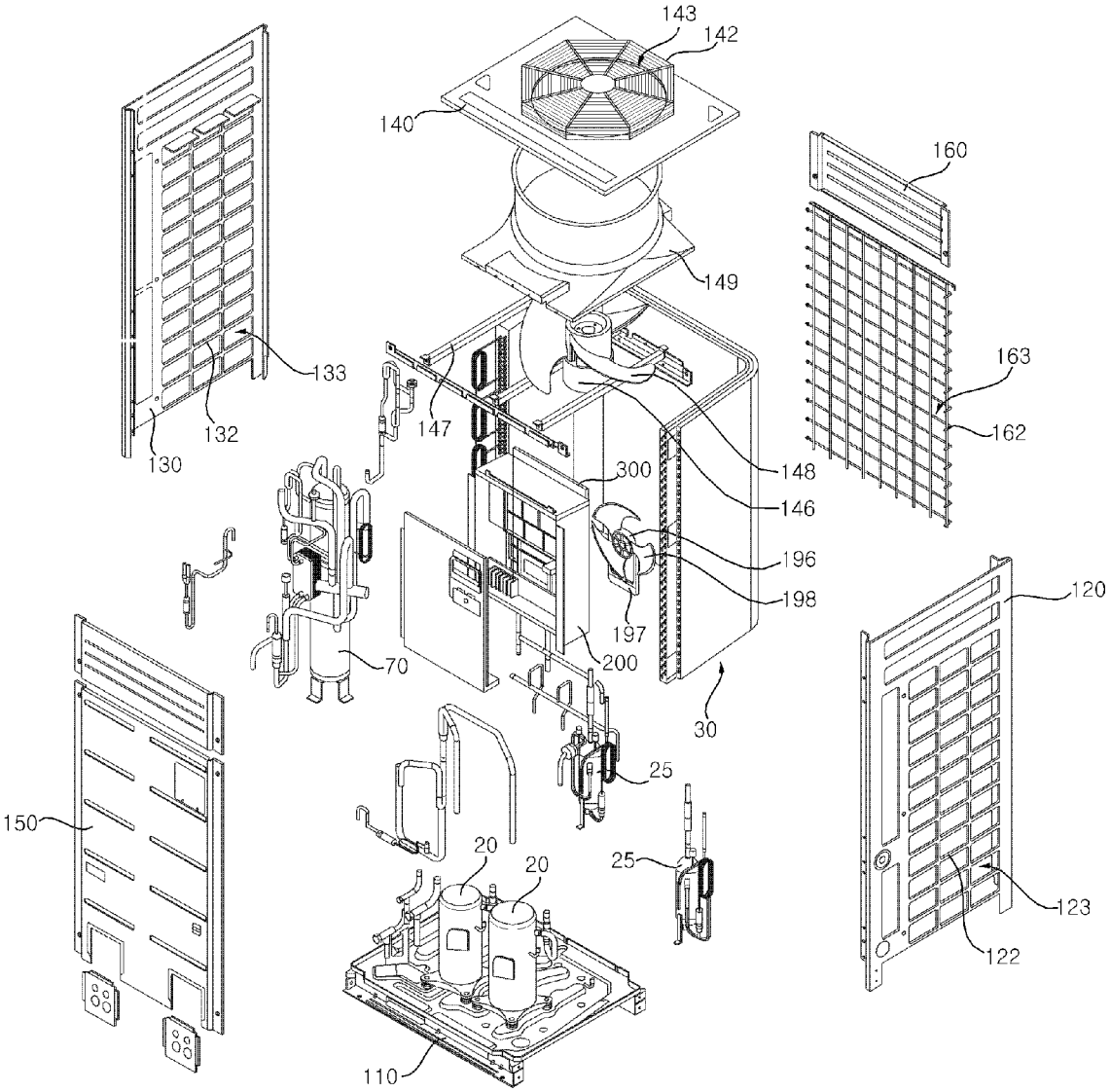
FIG. 3 is an exploded perspective view illustrating the outdoor unit of the air conditioner according to the illustrated embodiment of the present invention.

FIG. 2 is a perspective view illustrating a configuration of the outdoor unit of the air conditioner according to an embodiment of the present invention. FIG. 3 is an exploded perspective view illustrating the outdoor unit of the air conditioner according to the illustrated embodiment of the present invention.

Referring to FIGS. 2 and 3, the outdoor unit of the air conditioner 1 according to the illustrated embodiment includes an outdoor unit base 110 to form a bottom wall, and an outdoor unit body 100 coupled to the outdoor unit base 110, and formed with suction holes to suck air at a peripheral wall of the outdoor unit body 100 while being formed with a discharge hole 143 at a top wall of the outdoor unit body 100. The outdoor heat exchanger 30, which is also included in the outdoor unit, is arranged in the outdoor unit body 100 such that the outdoor heat exchanger 30 corresponds to the suction holes. The outdoor unit further includes a discharge fan 148 arranged at the discharge hole 143 of the outdoor unit body 100, to force air to flow in a vertical direction, and a suction fan 198 arranged at a lower portion of the outdoor unit body 100, to force air to flow in a horizontal direction.

In the illustrated embodiment, upward and downward directions mean directions of gravity, namely, vertical directions, and forward and rearward directions and left and light directions are horizontal directions perpendicular to the vertical directions.

The outdoor unit base 110 and outdoor unit body 100 constitute a case, which forms an appearance of the outdoor unit. The outdoor unit base 110 forms an appearance of the bottom wall of the case. The compressor 20, an oil separator 25, the gas-liquid separator 70, the outdoor heat exchanger 30, etc. are installed on the bottom wall of the case.

The outdoor unit body 100 is coupled to the outdoor unit base 110. The outdoor unit body 100 has a rectangular parallelepiped structure open at a bottom side thereof. The outdoor unit body 100 is formed, at the peripheral wall thereof, with suction holes to suck air. The outdoor unit body 100 is formed, at the top wall thereof, with the discharge hole 143. The suction holes may be formed at three sides of the peripheral wall of the outdoor unit body 100. For example, the suction holes may be formed at rear, left and right walls of the outdoor unit body 100. In the illustrated embodiment, the suction holes include a left suction hole 123, a right suction hole 133, and a rear suction hole 163.

The outdoor unit body 100 includes a left panel 120 to form the left wall, the right panel 130 to form the right wall, a top panel 140 to form the top wall, a front panel 150 to form a front wall of the outdoor unit body 100, and a rear panel 160 to form a rear wall of the outdoor unit body 100.

The left panel 120 forms a left appearance of the outdoor unit. The left panel 120 is coupled to a left side of the outdoor unit base 110. A left grill 122 is provided at the left panel 120, to allow outdoor air to be sucked into the outdoor unit body 100. The left grill 122 forms the left suction hole 123 to suck outdoor air at the left side.

The right panel 130 forms a right appearance of the outdoor unit. The right panel 130 is coupled to a right side of the outdoor unit base 110. A right grill 132 is provided at the right panel 130, to allow outdoor air to be sucked into the outdoor unit body 100. The right grill 132 forms the right suction hole 133 to suck outdoor air at the right side.

The top panel 140 forms a top appearance of the outdoor unit. The top panel 140 is coupled to upper ends of the left panel 120 and right panel 130. The top panel 140 is formed with the discharge hole 143. A discharge grill may be provided at the top panel 140 such that the discharge grill is arranged over the discharge hole 143.

The front panel 150 forms a front appearance of the outdoor unit. The front panel 150 is arranged at front sides of the outdoor unit base 110, left panel 120, right panel 130 and top panel 140 while being surrounded by the outdoor unit base 110, left panel 120, right panel 130 and top panel 140.

The rear panel 160 forms a rear appearance of the outdoor unit. The rear panel 160 is arranged at rear sides of the left panel 120, right panel 130 and top panel 140 while being surrounded by the left panel 120, right panel 130 and top panel 140. A rear grill 162 is provided at the rear panel 160, to allow outdoor air to be sucked into the outdoor unit body 100. The rear grill 162 forms the rear suction hole 163 to suck outdoor air at the rear side.

The outdoor heat exchanger 30 is arranged in the outdoor unit body 100 such that the outdoor heat exchanger 30 corresponds to the suction holes. In the illustrated embodiment, the suction holes include the left suction hole 123, right suction hole 133, and rear suction hole 163 and, as such, the outdoor heat exchanger 30 has a U-shaped horizontal cross-section having three sides. The outdoor heat exchanger 30, which has three sides, is arranged to surround the compressor 20, oil separator 25, and gas-liquid separator 70 installed on an upper surface of the outdoor unit base 110.

The left side of the outdoor heat exchanger 30 is arranged to correspond to the left suction hole 123 formed at the left grill 122. The right side of the outdoor heat exchanger 30 is arranged to correspond to the right suction hole 133 formed at the right grill 132. The rear side of the outdoor heat exchanger 30, which is a middle side, is arranged to correspond to the rear suction hole 163 formed at the rear grill 162.

The discharge fan 148 is provided at the discharge hole 143 of the outdoor unit body 100, to force air to flow in a vertical direction. The discharge fan 148 is arranged beneath the top panel 140 to correspond to the discharge hole 143. The discharge fan 148 is supported by a discharge bracket 147 connected to the front panel 150 and rear panel 160.

The discharge fan 148 is rotated by a discharge motor 146. The discharge motor 146 is mounted to the discharge bracket 147. An orifice 149 is arranged around the discharge fan 148, to form a flow path. The orifice 149 is connected to the front panel 150 and rear panel 160 while being arranged beneath the top panel 140.

The discharge fan 148 forces outdoor air to flow such that the outdoor air exchanges heat with refrigerant in the outdoor heat exchanger 30. The discharge fan 148 may be an axial fan in which an axis thereof extends in a vertical direction (upward and downward directions), to discharge outdoor air outwards from the interior of the outdoor unit body 100. The discharge fan 148 discharges outdoor air sucked into the suction holes 123, 133, and 163 in an upward direction.

The suction fan 198 is arranged at the lower portion of the outdoor unit body 100, to force air to flow in a horizontal direction. The suction fan 198 is arranged over the outdoor unit base 110. The suction fan 198 is supported by a suction bracket 197 connected to the upper surface of the outdoor unit base 110. The suction fan 198 is rotated by a suction motor 196. The suction motor 196 is mounted to the suction bracket 197.

The suction fan 198 forces outdoor air to flow, together with a blower 200, such that the outdoor air exchanges heat with refrigerant in the outdoor heat exchanger 30. Accordingly, when both the discharge fan 148 and the suction fan 198 force outdoor air to flow, efficiency of the air conditioner in the cooling and heating modes is enhanced, as compared to the case in which heat exchange in the outdoor heat exchanger 30 is achieved through flow of outdoor air generated by the discharge fan 148 alone without using the suction fan 198.

The suction fan 198 may be an axial fan in which an axis thereof extends in a horizontal direction, to suck outdoor air inwards from the outside of the outdoor unit body 100. The axis of the suction fan 198 may extend in forward and rearward directions, to force air to flow in the forward and rearward directions.

The controller 200 is a part to control the compressor 20, outdoor expansion valve 50, indoor expansion valve 60, switching valve 80, suction motor 196, discharge motor 146, etc. in accordance with required cooling and heating performances.

Figure 4:
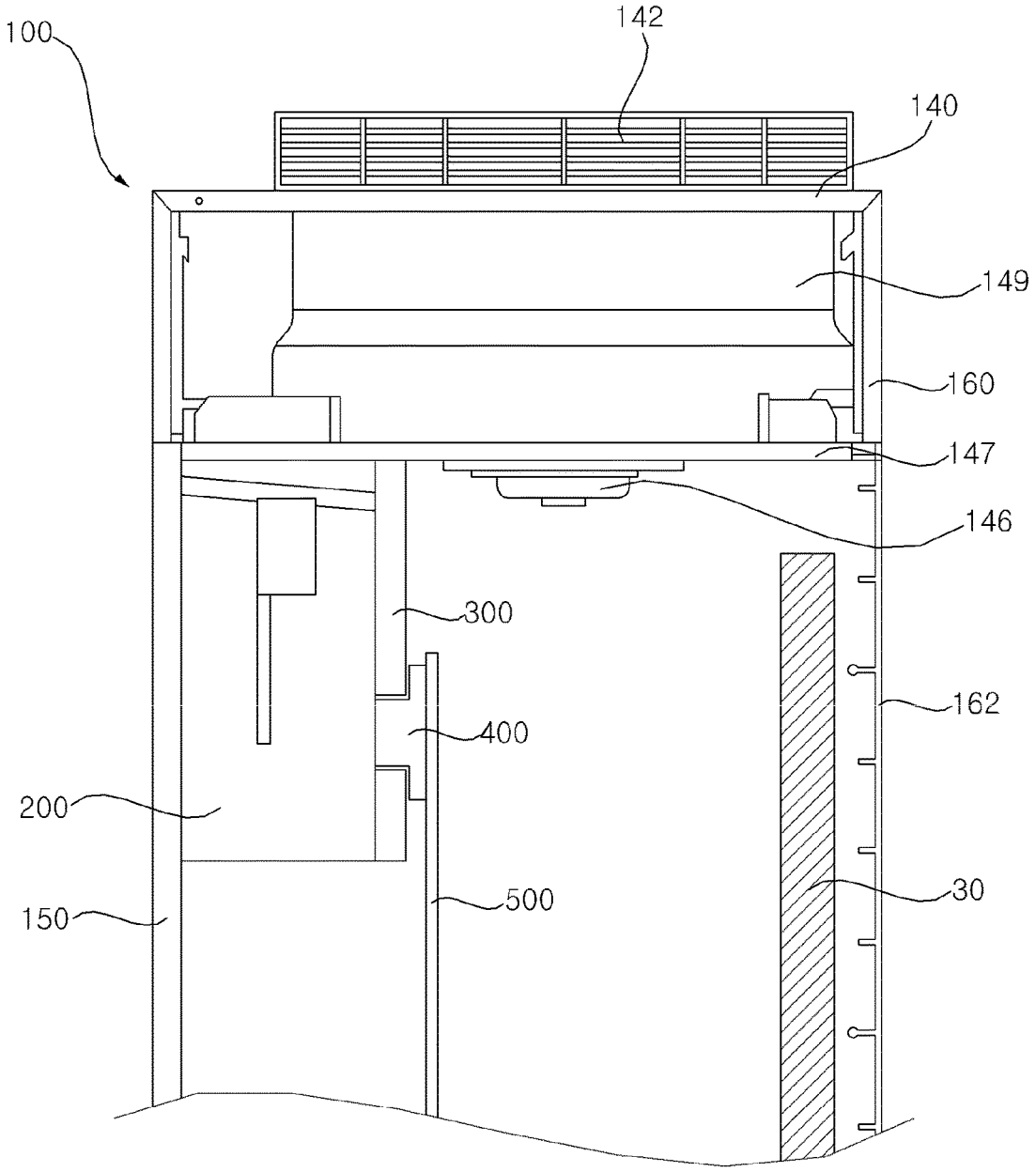
FIG. 4 is a side sectional view illustrating the outdoor unit of the air conditioner according to the illustrated embodiment of the present invention.
Figure 5A:
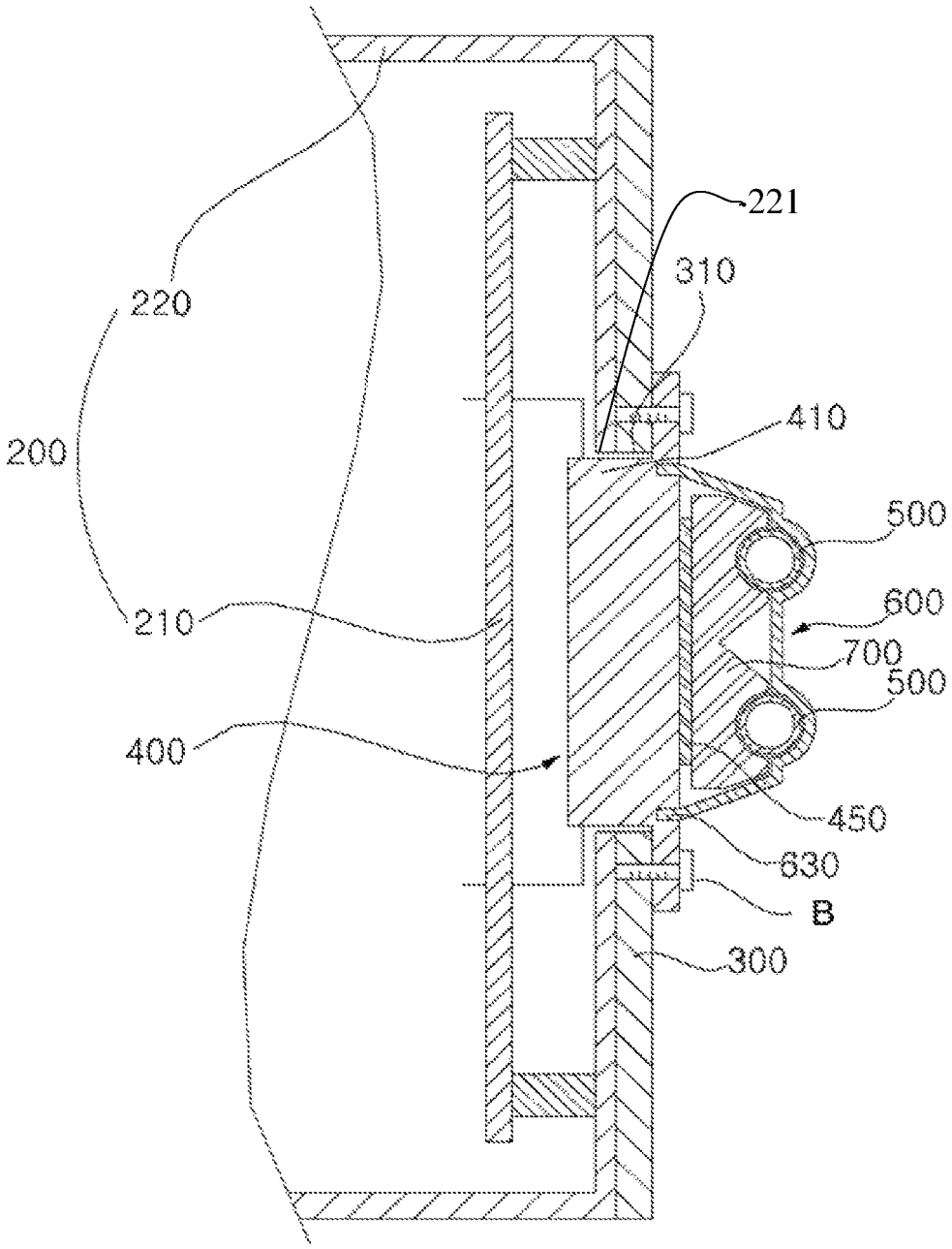
FIG. 5A is a view illustrating cross-sections of a controller, a support member and a heat radiation unit, which are illustrated in FIG. 4.
Figure 5B:
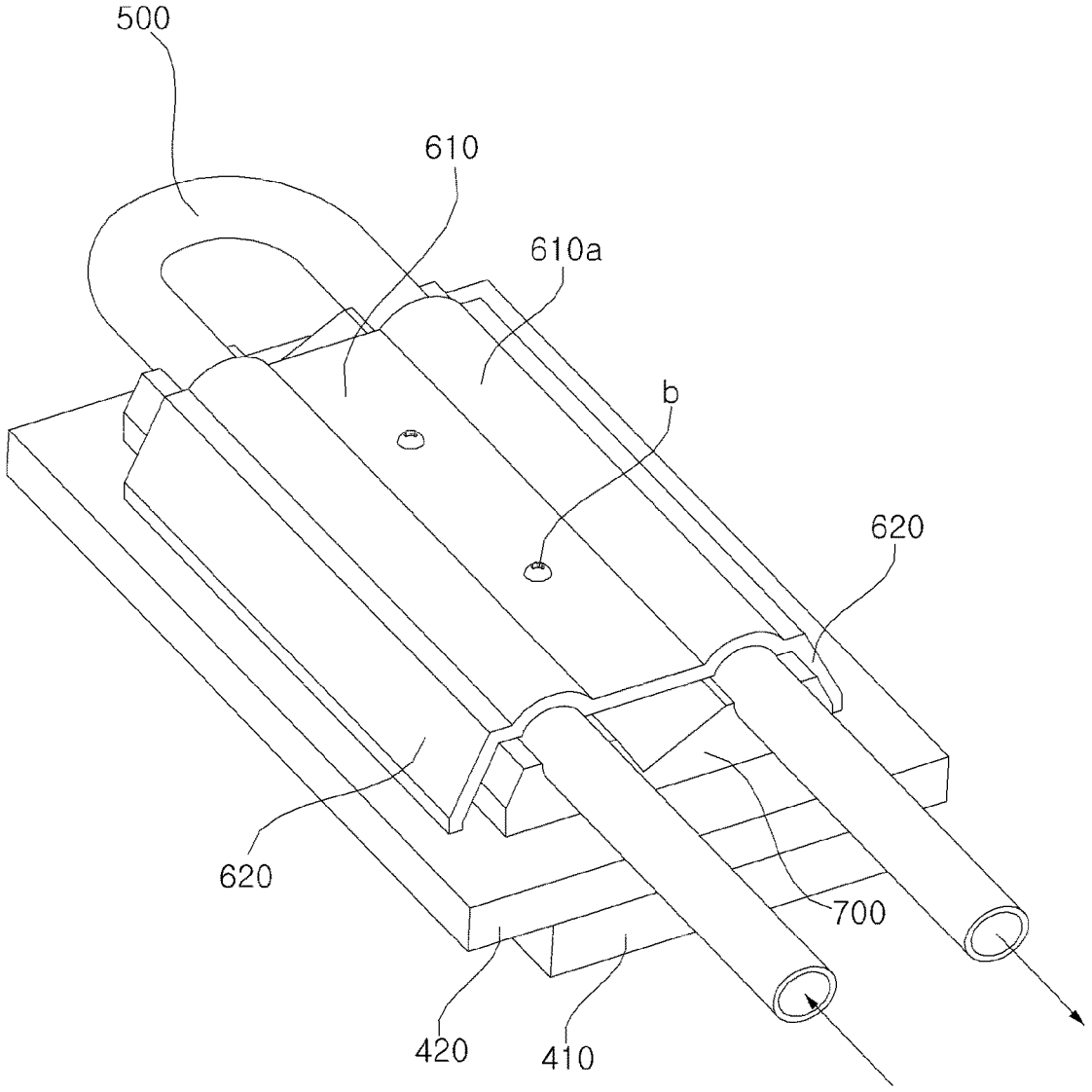
FIG. 5B is an assembled perspective view illustrating the heat radiation unit according to the illustrated embodiment of the present invention.
Figure 5C:
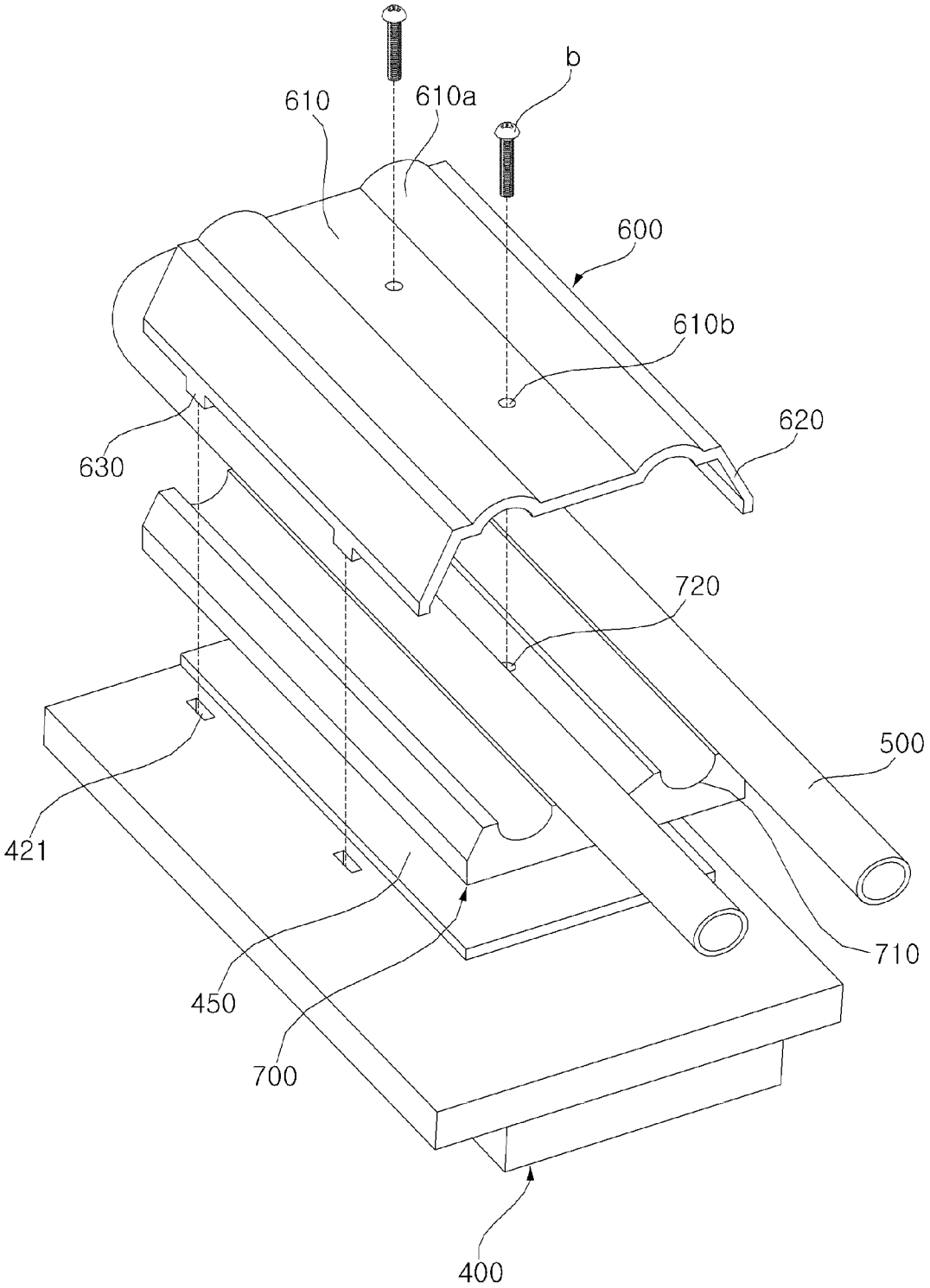
FIG. 5C is an exploded perspective view of the heat radiation unit according to the illustrated embodiment of the present invention.
Figure 6:
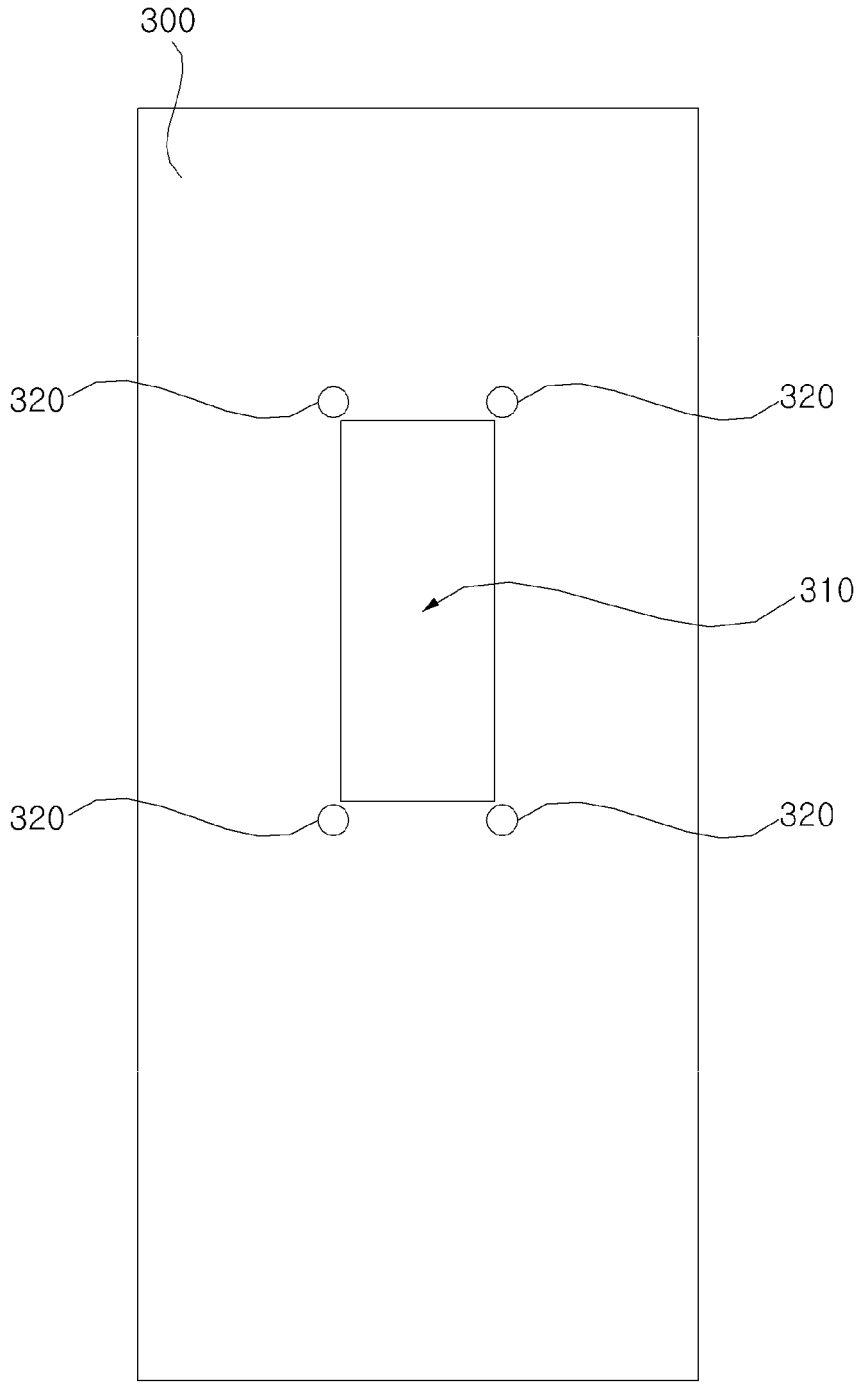
FIG. 6 is a view illustrating the support member according to the illustrated embodiment of the present invention.

FIG. 4 is a side sectional view illustrating the outdoor unit of the air conditioner according to the illustrated embodiment of the present invention. FIG. 5A is a view illustrating cross-sections of the controller, a support member and a heat radiation unit, which are illustrated in FIG. 4. FIG. 5B is an assembled perspective view illustrating the heat radiation unit according to the illustrated embodiment of the present invention. FIG. 5C is an exploded perspective view of the heat radiation unit according to the illustrated embodiment of the present invention. FIG. 6 is a view illustrating the support member according to the illustrated embodiment of the present invention.

Referring to FIGS. 4 to 6, the discharge bracket 147 is mounted between the front panel 150 and the rear panel 160, to connect the front panel 150 and rear panel 160. The discharge bracket 147 divides the interior of the outdoor unit (case) into an upper compartment and a lower compartment. That is, the discharge bracket 147 defines a lower compartment in which the compressor 20, outdoor heat exchanger 30, suction fan 198, controller 200, etc. are installed, and an upper compartment in which the orifice, discharge fan 148, etc. are installed.

The discharge unit is provided at the outdoor unit having the above-described configuration, to radiate heat from a heat source, namely, the controller 200.

The heat radiation unit according to the illustrated embodiment includes a heat radiation member 400 thermally connected to the heat source, to radiate heat generated from the heat source, a refrigerant pipe 500 thermally connected to the heat radiation member 400 while being formed therein with a channel, through which refrigerant flows, a pipe jacket 700 coupled to the heat radiation member 400, and formed with a receiving groove 710 to receive a portion of the refrigerant pipe 500, and a cover bracket 600 to press the portion of the refrigerant pipe 500 received in the receiving groove 710 of the pipe jacket 700 in a downward direction of the receiving groove 710.

The heat source is a device, which generates heat or radiates heat during operation thereof. For example, the heat source is a controller of an electronic appliance. In detail, the heat source may be the controller 200 of the air conditioner. Of course, the present invention is not limited to such conditions. The following description will be given in conjunction with the case in which the heat source is the controller 200 of the air conditioner.

The controller 200, which is a heat source, is arranged in the interior of the case, and may control operation of various constituent elements of the air conditioner. The controller 200 may be arranged at various positions in the interior of the case in accordance with the performance or kind of the air conditioner. The controller 200 may be coupled to at least one of the front panel 150, right panel 130, and left panel 120 of the case, to be installed at an intermediate portion of the case. In the illustrated embodiment, the controller 200 is installed at an intermediate portion of the front panel 150. In addition, the controller 200 may be separably bolted to the case.

The controller 200 is thermally connected to the heat radiation member 400, to radiate heat generated from the controller 200, and, as such, prevents increase in temperature of the controller 200. In the illustrated embodiment, the controller 200 is connected, at a rear side thereof, to the heat radiation member 400.

In this case, thermal connection of the controller 200 to the heat radiation member 400 means that the controller 200 and heat radiation member 400 directly contact each other or indirectly contact each other by another heat transfer member.

The controller 200 includes a printed circuit board (PCB) 210 to control operation of various constituent elements of the air conditioner, and a control box 220 to form a space for receiving the PCB 210.

The controller 200 functions to control electric power or the like supplied to various constituent elements of the air conditioner. A plurality of electric elements is mounted in the controller 200. For this reason, heat may be generated in the controller 200 during operation of the outdoor unit and, as such, temperature of the controller 200 may increase. When temperature of the controller 200 increases as described above, the electric elements mounted in the controller 200, for example, the PCB 210, may be damaged. For this reason, it is desired to radiate heat generated from the controller 200 through the heat radiation member 400.

The controller 200 may be separably coupled to a support member 200, to which the heat radiation member 400 is connected. Accordingly, when the controller 200 malfunctions, the controller 200 may be easily separated from the support member 200.

The control box 220 forms an appearance of the controller 200. The control box 220 is formed with a space to receive elements such as the PCB 210. In the illustrated embodiment, the control box 220 has a square or rectangular box shape. A connecting hole 221 may be formed at a rear side of the control box 220, to receive the heat radiation member 400. The connecting hole 221 may be formed at a position corresponding to the PCB 210 disposed in the control box 220.

The PCB 210 is mounted in the control box 220. The PCB 210 includes a plurality of control elements such as a power element to generate an operating frequency of the compressor 20 when the compressor 20 is of an inverter type. The power element is a switching element to generate an operating frequency of the compressor 20 and, as such, generate a large amount of heat during generation of the operating frequency. For this reason, the PCB 210 may be damaged unless the PCB 210 is cooled through radiation of heat generated by the power element. To this end, the PCB 210 may be connected to the heat radiation member 400 at a surface thereof opposite to a surface, on which the power element is mounted, to radiate heat generated from the power element.

The heat radiation member 400 is thermally connected to the controller 200, which is a heat source, and, as such, radiates heat generated from the controller 200.

For example, the heat radiation member 400 may directly contact one surface of the controller 200. In another embodiment, the heat radiation member 400 is connected to the PCB 210 arranged in the control box 220 through the connecting hole 221 of the control box 220. Accordingly, the heat radiation member 400 radiates heat generated from the power element provided at the PCB 210, thereby cooling the PBC 210. Thus, the power element provided at the PCB 210 may be maintained at an operable temperature.

The heat radiation member 400 is arranged opposite the controller 200 with reference to the support member 300.

A portion of the heat radiation member 400 may contact the controller 200 while extending through an insertion hole 310.

In detail, the heat radiation member 400 includes a contact portion 410 to contact the controller 200 (in detail, the PCB 210), and a coupling portion 420 to be coupled to the support member 300.

The contact portion 410 extends through the fitting hole 310, to contact the controller 200. In addition, the contact portion 410 has a size and shape corresponding to that of the fitting hole 310. The contact portion 410 may protrude beyond the support member 300 toward the controller 200.

In detail, the contact portion may extend through the fitting hole 310 and, as such, contacts the PCB 210. In addition, the contact portion 410 may extend through the fitting hole 310, to be separably coupled to the PCB 210. The coupling portion 420 is a portion of the heat radiation member 400 to be coupled to the support member 300.

The coupling portion 420 is formed to extend outwards from the contact portion 410 and, as such, overlaps the support member 300, which forms a peripheral edge of the fitting hole 310. In this case, the overlap direction of the coupling portion 420 may include a vertical direction or a horizontal direction.

The coupling portion 420 and support member 300 may be bolted together. In detail, bolts are coupled to the coupling portion 420 overlapping the support member 300, which forms the peripheral edge of the fitting hole 310.

The heat radiation member 400 may be primarily fixed by the support member 300 as the contact portion 410 thereof is fitted in the fitting hole 310 formed through the support member 300. In addition, the heat radiation member 400 may be secondarily fixed by the support member 300 as the coupling portion 420 thereof is bolted to the support member 300. That is, the heat radiation member 400 is fixed in position as the heat radiation member 400 is fitted in the fitting hole 310 formed through the support member 300, and is then bolted to the support member 300.

The heat radiation member 400 is coupled, at one side thereof, to the controller 200 while being coupled, at the other side thereof opposing the former side, to the refrigerant pipe 500, through which refrigerant flows. In the illustrated embodiment, the heat radiation member 400 is coupled, at a lower side thereof (in FIG. 5B), to the controller 200 while being coupled, at an upper side thereof, to the refrigerant pipe 500.

Accordingly, the heat radiation member 400 may radiate heat generated from the controller 200 to refrigerant flowing through the refrigerant pipe 500. The heat radiation member 400 may be made of a material having relatively high thermal conductivity such as aluminum. In another embodiment, the heat radiation member 400 may include a heat radiation plate to contact the PCB 210, and a plurality of heat radiation fins connected to the refrigerant pipe 500. The heat radiation fins increase the contact area of the heat radiation member 400 contacting refrigerant, thereby enhancing heat radiation effects.

The support member 300 is coupled to the heat radiation member 400, to fix the heat radiation member 400 at a desired position. The support member is arranged in the interior of the case, and is disposed at a position corresponding to that of the controller 200. The support member 300 may have a longitudinally elongated plate shape. The support member 300 is coupled, at a top end thereof, to the discharge bracket 147, or is coupled, at at least one side thereof, to at least one of the right panel 130 and left panel 120 and, as such, is mounted to the case. In the illustrated embodiment, the support member 300 is mounted to the intermediate portion of the case, together with the controller 200.

The support member 300 may be separably coupled to the controller 200 at one side thereof. In addition, the heat radiation member 400 may be coupled to the other side of the support member 300 opposing the side of the support member 300 coupled to the controller 200. The support member 300 forms the fitting hole 310, in which the contact portion 410 of the heat radiation member 400 is fitted. The fitting hole 310 has a size corresponding to that of the contact portion 410 of the heat radiation member 400. Accordingly, as the contact portion 410 of the heat radiation member 400 is fitted in the fitting hole 310, the heat radiation member 400 is primarily fixed to the support member 300. In addition, the support member 300 is formed, around the fitting hole 310, with fastening holes 320, through which bolts B are fastened. In the illustrated embodiment, the fitting hole 310 has a square shape, and the fastening holes 320 are formed at respective corners of the fitting hole 310. Accordingly, the support member 300 is bolted to the coupling portion 420 of the heat radiation member 400. Thus, the heat radiation member 400 is secondarily fixed to the support member 300.

The fitting hole 310 of the support member 300 is formed at a position corresponding to that of the connecting hole 221 formed through the control box 220. That is, the fitting hole 310 of the support member 300 may be arranged to overlap the connecting hole 221 formed through the control box 220.

Accordingly, the contact portion 410 of the heat radiation member 400 may be connected to the PCB 210 through the fitting hole 310 and connecting hole 221 without any interference with elements disposed therearound. The support member 300 may be made of a material having high rigidity because the support member 300 should support the weight of the heat radiation member 400 and the weight of the refrigerant pipe 500 connected to the heat radiation member 400.

The refrigerant pipe 500 is thermally connected to the heat radiation member 400, and is formed therein with a channel, through which refrigerant flows.

In detail, the refrigerant pipe 500 is coupled to the other surface of the heat radiation member 400 opposing the surface of the heat radiation member 400 contacting the controller 200. Through the refrigerant pipe 500, refrigerant, which is a bypassed portion of refrigerant emerging from the outdoor heat exchanger 30 or indoor heat exchanger 40, flows. The refrigerant has a U shape. Accordingly, refrigerant flowing through the refrigerant pipe 500 primarily absorbs heat while flowing upwards, and secondarily absorbs heat while flowing downwards and, as such, an enhancement in heat radiation efficiency is achieved.

Of course, the refrigerant pipe 500 may be configured such that refrigerant flowing through the refrigerant pipe 500 flows to the side of the discharge fan 148 after exchanging heat with the heat radiation member 400. Accordingly, the refrigerant flowing through the refrigerant pipe 500 is cooled by air.

In this case, the refrigerant pipe 500 may directly contact the heat radiation member 400. However, the refrigerant pipe 500 may be indirectly connected to the heat radiation member 400 by the pipe jacket 700, taking into consideration the shape of the refrigerant pipe 500.

The pipe jacket 700 increases the contact area of the heat radiation member 400 contacting the refrigerant pipe 500, thereby achieving an enhancement in heat transfer efficiency. In addition, the pipe jacket 700 reduces poor contact caused by shape difference between the heat radiation member 400 and the refrigerant pipe 500.

In addition, the pipe jacket 700 surface-contacts the heat radiation member 400. In detail, a heat radiation pad 450 is interposed between the pipe jacket 700 and the heat radiation member 400. The heat radiation pad 450 adheres between the pipe jacket 700 and the heat radiation member 400. For example, the heat radiation pad 450 may be a material having superior adhesion and excellent thermal conductivity. The heat radiation pad 450 may be a thermal grease. Alternatively, the heat radiation pad 450 may have a sheet shape.

In detail, the pipe jacket 700 contacts the heat radiation member 400 at a lower surface thereof, and is formed, at an upper surface thereof, with a receiving groove 710 to receive a portion of the refrigerant pipe 500.

The receiving groove 710 is formed by recessing the corresponding portion of the pipe jacket 700. The receiving groove 710 has a shape corresponding to an outer surface of the refrigerant pipe 500 and, as such, increases the contact area between the refrigerant pipe 500 and the pipe jacket 700. The pipe jacket 700 enables easy separation of the refrigerant pipe 500.

In particular, the receiving groove 710 is formed to surround a lower portion of the refrigerant pipe 500 (in FIG. 5B). The receiving groove 710 is elongated in a longitudinal direction of the refrigerant pipe 500. Of course, two receiving grooves 710 may be provided. The receiving groove 710 is formed at an upper portion of the pipe jacket 700.

In addition, the pipe jacket 700 may be formed with fastening holes 720, to which fastening members inserted into the cover bracket 600, namely, bolts b, are fastened.

The cover bracket 600 presses the refrigerant pipe 500 received in the receiving groove 710 of the pipe jacket 700 in a downward direction of the receiving groove 710. Thermal conductivity between constituent elements is proportional to the cross-sectional contact area between the constituent elements. Of course, there may be a problem in that the constituent elements may incompletely contact each other due to tolerances thereof generated in production.

To this end, the cover bracket 600 presses the refrigerant conduit 500 to closely contact the receiving groove 710. In addition, the cover bracket 600 presses the pipe jacket 700 to closely contact the heat radiation member 400.

For example, the cover bracket 600 covers at least a portion of the refrigerant pipe 500 exposed to the outside of the receiving groove 710, and is separably coupled to the heat radiation member 400. The cover bracket 600 has a plate shape.

In detail, the cover bracket 600 includes a pressing portion 610, elastic portions 620, and fitting portions 630.

The pressing portion 610 presses at least the refrigerant pipe 500. In addition, the pressing portion 610 presses the refrigerant pipe 500 and pipe jacket 700.

In detail, the pressing portion 610 has at least one pipe groove 610*a* to receive the refrigerant pipe 500 and, as such, covers an upper portion of the refrigerant pipe 500 and the pipe jacket 700.

The pipe groove 610*a* is formed to correspond to the refrigerant pipe 500. In detail, the pipe groove 610*a* defines, together with the receiving groove 710, a space in which the refrigerant pipe 500 is disposed. That is, when viewed through a cross-section, the receiving groove 710 surrounds an upper region of the outer surface of the refrigerant pipe 500, and the pipe groove 610*a* surrounds a lower region of the outer surface of the refrigerant pipe 500. In this case, the cover bracket 600 is thermally connected to the heat radiation member 400 and, as such, transfers heat to the refrigerant pipe 500 via the pipe groove 610*a*.

The pressing portion 610 covers the pipe jacket 700, together with the refrigerant pipe 500. In detail, the pressing portion 610 is formed to correspond to the upper portion of the pipe jacket 700 and, as such, covers the upper portion of the pipe jacket 700. That is, the pressing portion 610 contacts the upper portion of the pipe jacket 700 at a portion thereof while contacting the upper portion of the refrigerant pipe 500 at the remaining portion thereof.

The pressing portion 610 presses the refrigerant pipe 500 against the pipe jacket 700 while pressing the pipe jacket 700 against the heat radiation member 400 by the elastic portions 620 or fastening members. Accordingly, the refrigerant pipe 500 and pipe jacket 700 closely contact each other, and the pipe jacket 700 and heat radiation member 400 closely contact each other and, as such, enhanced thermal conductivity is achieved. In addition, the pressing portion 610 surrounds the upper portion of the refrigerant pipe 500 and, as such, transfers heat between the refrigerant pipe 500 and the heat radiation member 400.

In addition, the pressing portion 610 is formed with holes 610*b*, through which fastening members are inserted, respectively.

The elastic portions 620 apply elastic force to the pressing portion 610. In detail, the elastic portions 620 extend from opposite ends of the pressing portion 610, to surround opposite side surfaces of the pipe jacket 700.

The elastic portions 620 have a plate shape inclined downwards from the pressing portion 610. The elastic portions 620 apply elastic force by virtue of the material thereof. In detail, the elastic portions 620 exhibit elastic restoration forces in directions that the elastic portions 620 move away from each other, respectively. In detail, the elastic portions 620 are formed integrally with the pressing portion 610, and are bent from the pressing portion 610. In addition, each elastic portion 620 contacts the heat radiation member 400 at one end thereof and, as such, transfers heat received from the heat radiation member 400 to the pressing portion 610.

The fitting portions 630 are fitted in fitting grooves 421 formed at the heat radiation member 400, to couple the cover bracket 600 to the heat radiation member 400. In detail, the fitting portions 630 protrude from the corresponding elastic portions 620, and may be hooked in the fitting grooves 421 formed at the heat radiation member 400, respectively. In this case, when the fitting portions 630 are fitted in the fitting grooves 421, respectively, the elastic portions 620 are elastically deformed and, as such, elastic force may be accumulated.

The cover bracket 600 may be fastened by fastening members. In detail, the fastening members may be bolts b. In this case, fastening holes are formed at the heat radiation member 400 or pipe jacket 700, to fasten the bolts b. In the illustrated embodiment, fastening holes 720 are formed at the pipe jacket 700.

Figure 7:
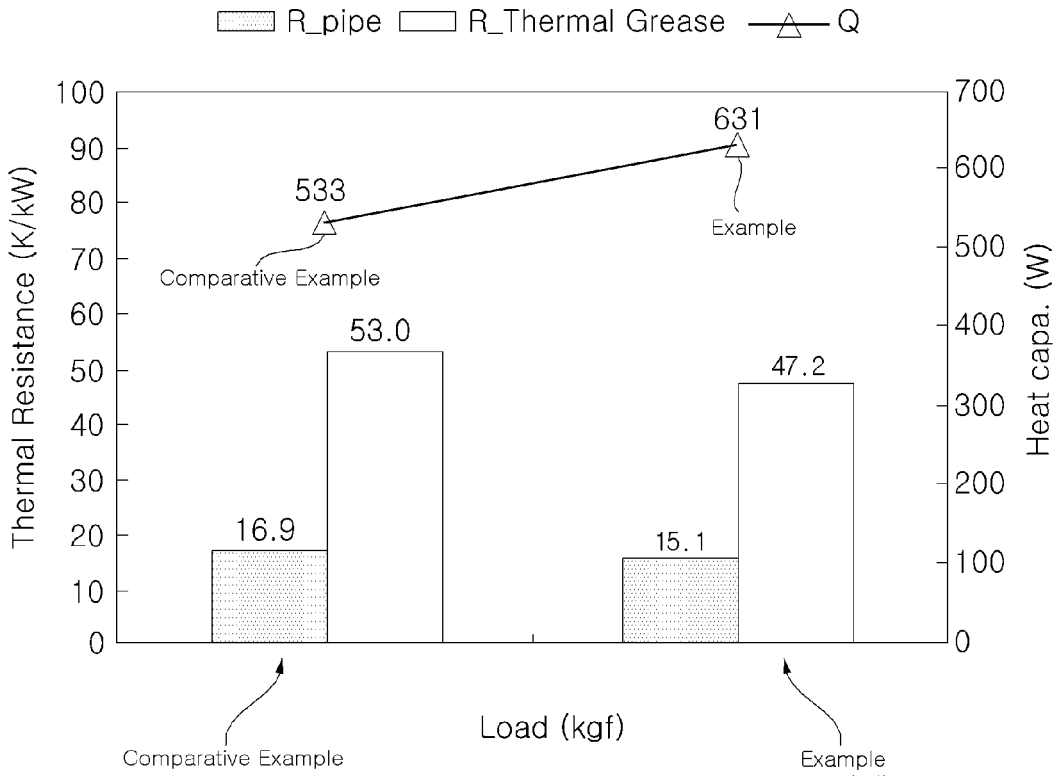
FIG. 7 is a test graph for comparison of an example according to an embodiment of the present invention with a comparative example in terms of thermal resistance.

FIG. 7 is a test graph for comparison of an example according to an embodiment of the present invention with a comparative example in terms of thermal resistance.

Referring to FIG. 7, the example is the case in which pressure is applied by the cover bracket 600, and the comparative example is the case in which the cover bracket 600 is omitted from the example.

The comparative example is identical to the example in terms of other conditions.

The thermal resistance R_pipe at a pipe jacket-refrigerant pipe junction in the comparative example is 16.9K/kw, whereas the thermal resistance R_pipe at a pipe jacket-refrigerant pipe junction in the example is 15.1K/kw. Accordingly, it can be seen that the example exhibits a reduction in thermal resistance at the pipe jacket-refrigerant pipe junction thereof and an enhancement in thermal conductivity.

In addition, the thermal resistance R_Thermal Grease at a heat radiation member-refrigerant pipe junction in the comparative example is 53.0K/kw, whereas the thermal resistance R_Thermal Grease at a heat radiation member-refrigerant pipe junction in the example is 47.2K/kw. Accordingly, it can be seen that the example exhibits a reduction in thermal resistance at the heat radiation member-refrigerant pipe junction thereof and an enhancement in thermal conductivity.

Thus, in the embodiment, there is an advantage in that the refrigerant pipe and heat source may have increased contact areas in spite of shape difference therebetween, and may be easily coupled to each other.

In addition, in the embodiment, there is an advantage in that enhanced heat radiation efficiency may be achieved in accordance with pressing of the refrigerant pipe through the cover bracket and thermal connection of the heat radiation member to the refrigerant pipe.

Furthermore, in the embodiment, there is an advantage in that it may be possible to prevent damage to the refrigerant because the heat radiation member connected to the refrigerant pipe is fixed to the support member.

In addition, in the embodiment, there is an advantage in that enhanced heat radiation efficiency is achieved because the heat radiation member closely contacts the controller by the support member.

The features, structures, effects, etc. as described above are included in at least one embodiment, and are not limited to a particular embodiment. In addition, although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An outdoor unit of an air conditioner comprising:

a case;

a heat source provided inside the case;

a heat radiation unit connected to the heat source, to radiate heat generated from the heat source, wherein the heat radiation unit comprises a heat radiation member connected to the heat source, to radiate heat generated from the heat source, a refrigerant pipe connected to the heat radiation member, a pipe jacket connected to the heat radiation member, and formed with a receiving groove to receive a portion of the refrigerant pipe, and a cover bracket to press against the portion of the refrigerant pipe received in the receiving groove in a downward direction of the receiving groove, wherein the cover bracket comprises a pressing portion having at least one pipe groove to receive the refrigerant pipe, the pressing portion pressing against an upper portion of the refrigerant pipe and the pipe jacket, respectively, wherein the pipe groove, together with the receiving groove, defines a space in which the refrigerant pipe is disposed, wherein the pipe groove, together with the receiving groove, entirely surrounds an outer surface of the refrigerant pipe in a region where the receiving groove and the pipe groove overlap, and wherein the pipe groove, together with the receiving groove, contacts the entirety of the outer surface of the refrigerant pipe in the region where the receiving groove and the pipe groove overlap, wherein the cover bracket further comprises:

a first elastic portion and a second elastic portion extending at opposite ends of the pressing portion, respectively, to apply an elastic force to the pressing portion, and a fitting portion provided in a fitting groove formed at the heat radiation member; and a support member coupled to the heat radiation member to fix the heat radiation member at a required position, the support member being formed with a fitting hole to receive the heat radiation member, wherein the heat radiation member comprises:

a contact portion extending through the fitting hole to contact a controller, the contact portion protruding beyond the support member toward the controller; and a coupling portion extending outward from the contact portion and overlapping the support member forming a peripheral edge of the fitting hole, wherein the heat radiation member is arranged opposite the controller with reference to the support member, wherein at least a portion of the heat radiation member extends through the fitting hole, and contacts the controller, and wherein a plurality of bolts are coupled to the coupling portion overlapping the support member.

2. The outdoor unit of claim 1, wherein the controller comprises a printed circuit board to control driving of an inverter compressor.

3. The outdoor unit of claim 1, wherein:

the controller further comprises a control box to receive the printed circuit board, the control box having a connecting hole provided at one side of the control box to receive the heat radiation member; and the contact portion of the heat radiation member passes through the connecting hole and connects with the printed circuit board.

4. The outdoor unit of claim 1, wherein the cover bracket covers at least a portion of the refrigerant pipe that is provided outside of the receiving groove.

5. The outdoor unit of claim 1, wherein the cover bracket is fastened to the heat radiation member by a fastener.

6. The outdoor unit of claim 1, wherein the first and second elastic portions each provide an elastic restoration force in a direction that the first and second elastic portions move away from each other, respectively.

* * * * *